US005564126A

United States Patent [19]

Chou

[11] Patent Number: 5,564,126

[45] Date of Patent: Oct. 15, 1996

[54] PARTIALLY OR FULLY OPEN UPPER GARMENT FOR PATIENTS

[75] Inventor: Chao-Mu Chou, Taipei, Taiwan

[73] Assignees: Chia-Tein Chou, Taipei; Shiu-Yin Cheng, Tao Yuan Hsien, both of Taiwan; part interest to each

[21] Appl. No.: 566,743

[22] Filed: Dec. 4, 1995

[51] Int. Cl.[6] ..... A41B 1/00; A41D 13/12

[52] U.S. Cl. ..... 2/114; 2/106; 2/115

[58] Field of Search ..... 2/70, 83, 111, 2/113, 114, 115, 913, 69.5, 104, 106, 119, 69, 108, 125

[56] References Cited

U.S. PATENT DOCUMENTS

| | | | |
|---|---|---|---|
| 459,106 | 9/1891 | Fifield | 2/114 |
| 4,258,440 | 3/1981 | McGowan | 2/114 |
| 4,382,303 | 5/1983 | Lunt | 2/114 |
| 5,133,086 | 7/1992 | Truitt et al. | 2/69 |

FOREIGN PATENT DOCUMENTS

| | | | |
|---|---|---|---|
| 2641215 | 9/1976 | Germany | 2/69 |
| 2267022 | 11/1993 | United Kingdom | 2/90 |

*Primary Examiner*—Amy B. Vanatta
*Attorney, Agent, or Firm*—Bucknam and Archer

[57] ABSTRACT

A partially or fully open type upper garment for patients includes a left front piece, a lower front piece, a rear piece, a left sleeve and a right sleeve sewn together. The left front piece and the right front piece is joined together by means of a first fastening device. At least one side of the front pieces is provided with a slit which runs lengthwise of said front piece and its contiguous sleeve. A second fastening device is provided at the slit.

1 Claim, 2 Drawing Sheets

PARTIALLY OR FULLY OPEN UPPER GARMENT FOR PATIENTS

BACKGROUND OF THE INVENTION (a) Field of the Invention

The present invention relates generally to an upper garment for patients, and more particularly to a partially or fully open upper garment for in-patients.

(b) Description of the Prior Art

Little attention has been paid to patients' wear in the past. At some hospitals, the patients' wear is so shabby that it does not cover the body properly. Besides, the conventional patients' wear is inconvenient and may obstruct routine medical examination, such as temperature taking, blood pressure taking, intravenous injection, etc., which is generally performed on the patient's arm and armpit. In the design of the conventional patient's wear, the sleeves cannot be rolled up easily, or the tubing may easily got entangled. It is inconvenient and sometimes impossible for the patient to change with tubings connected to the body. As in-patients have to be examined from time to time, normal outer garments are not suitable for them and specially designed garments for suiting their needs are necessary.

In 1993, the inventor of the present invention filed an application for "Upper Garment for Patients"under Ser. No. 08/055,833, which later issued as Pat. No. 5,392,466. In 1994, the inventor of the present invention filed another application for "Full-Open Type Upper Garment for Patients" under Ser. No. 08/273,190, which has also been allowed. These inventions have already been put into practice and have proved to be successful as evidenced by favorable comments from in-patients, their family members, nurses and medical assistants.

SUMMARY OF THE INVENTION

A primary object of the present invention is to provide a partially or fully open upper garment for patients which is simple in design and convenient in wearing.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
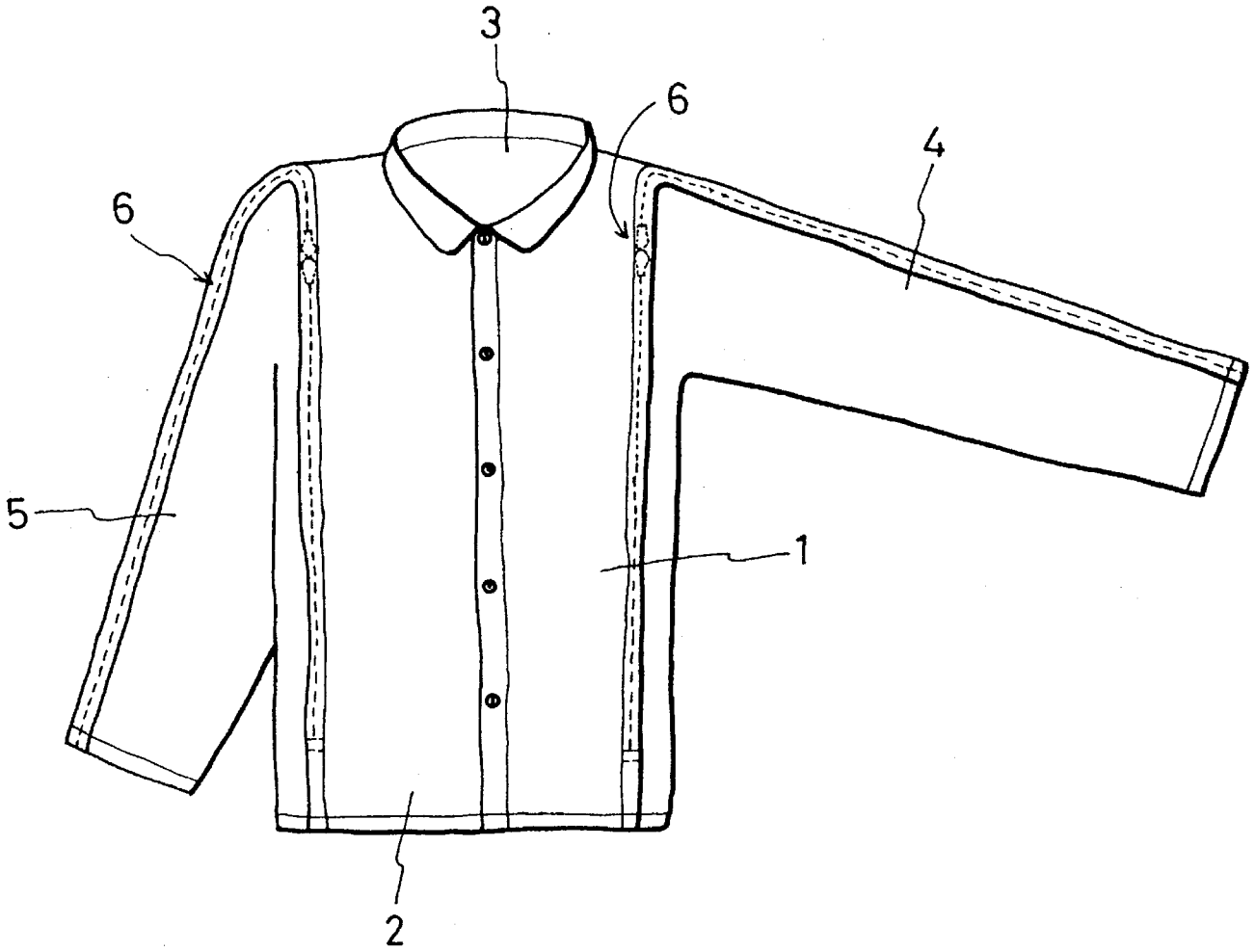
FIG. 1 is a schematic view of the upper garment of the present invention.

With reference to the drawings, the upper garment of the present invention fundamentally comprises, like the conventional upper garment for patients, a left front piece 1, a right front piece 2, a back piece 3 (not shown), a left sleeve 4 and a right sleeve 5 sewn together. The left front piece 1 and the right front piece 2 are joined by a zipper or a plurality of buttons. As such an arrangement is well known in the art, it will not be discussed herein.

The present invention is characterized in that at least the left front piece 1 together with the left sleeve 4 or the right front piece 2 together with the right sleeve 5 is configured to have a slit which runs lengthwise of the front piece and its contiguous sleeve and is provided with a fastening device 6. The fastening device 6 is preferably a zipper having at least a tail portion 61 at one of its ends. Preferably, tail portion 61 are arranged at both of its ends. The fastening device 6 has one or two slides 62 for opening or closing the fastening device 6. It is preferable to have two slides 62 disposed at both ends of the fastening device 6 for opening or closing the fastening device 6 from any one of the ends thereof via the tail portion 61.

As shown in FIG. 1, two fastening devices 6 are respectively provided to run along the side of the left front piece 1 to the left sleeve 4 and to run along the side of the right front piece 2 to the right sleeve 5. The front ends of the fastening devices 6 are located somewhere between the waist and the chest, while the portion therebelow is in a detached state.

In a best mode, the fastening device 6 is preferably provided only on the left front piece 1, in consideration of the position of the heart and the fact that most people are used to use their right hands. Such an arrangement facilitates treatment or examination made on the left arm, while the patient's right hand may be allowed to move freely. In the present invention, the left sleeve 4 may be partially or fully opened by means of the fastening device 6 to facilitate medical examination or treatment. For instance, when taking the blood pressure of a patient, the slide 62 of the fastening device 6 may be pulled upwardly to the left shoulder so that the left sleeve 4 is fully opened for taking blood pressure. When intravenous injection is required on the left arm, the tubing may be guided out along the left shoulder and the left sleeve 4 may be closed by means of the slides 62 to conceal the tubing inside the left sleeve 4. In this way, the tubing will be prevented from inadvertent pulling and the left arm may freely move to a certain extent. When taking a temperature, the left sleeve 4 is partially opened to form an opening through which the clinical thermometer may be inserted to be placed under the patient's armpit. To put on the upper garment according to the present invention, the patient firstly inserts his/her right arm into the right sleeve and places his/her left arm together with any needle or tubing on the fully opened left sleeve 4 which is closed subsequently with ease.

For very sick patients who can hardly move, a fastening device 6 may further be provided in the right front piece 2 and the right sleeve 5 so that the upper garment of the invention may be fully opened to facilitate medical examination or treatment.

Figure 2:
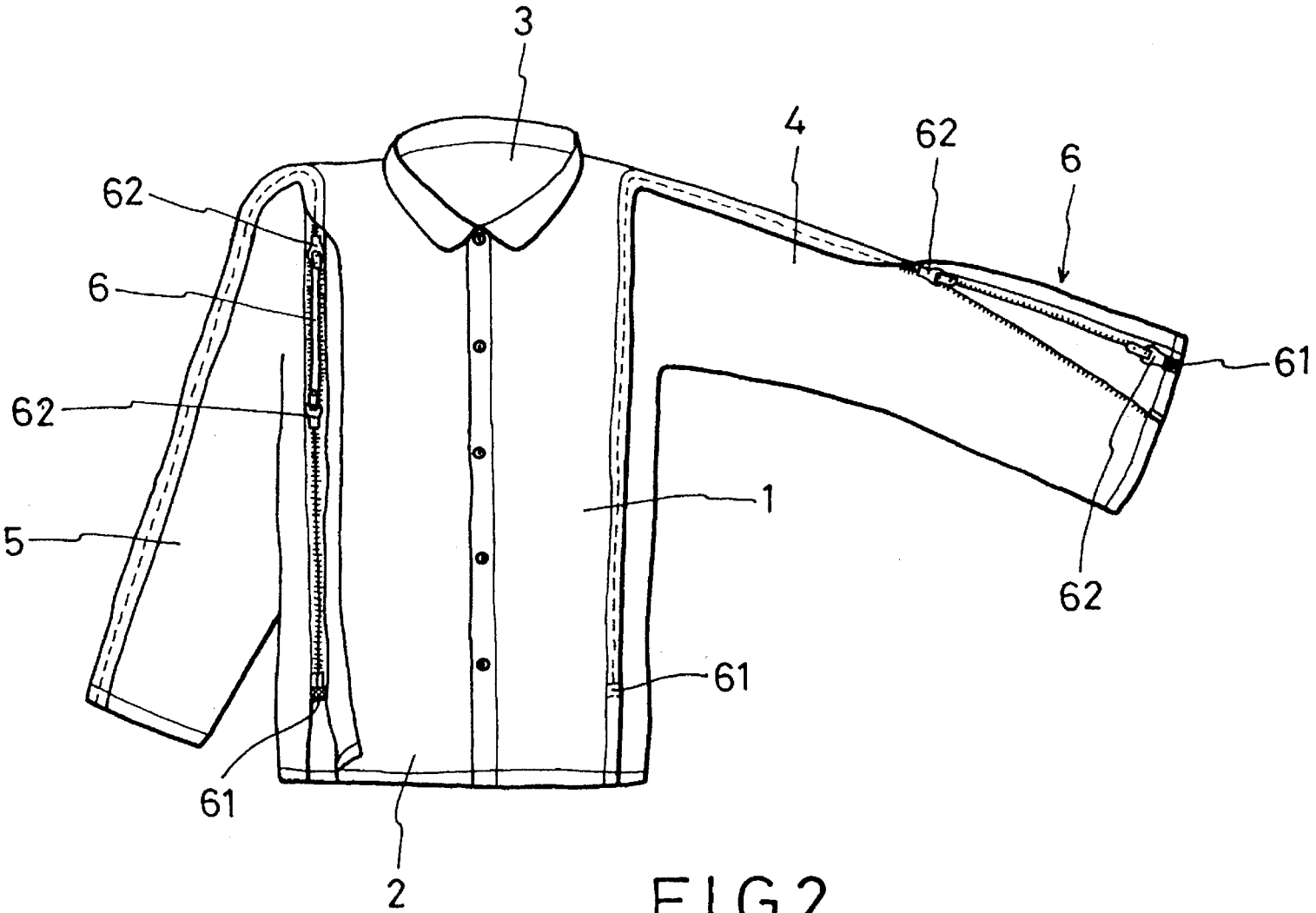
FIG. 2 is a schematic view of the upper garment in a partially or fully open state to facilitate medical examination or treatment.

Therefore, under normal circumstances, when the fastening devices 6 are in a closed state, they will not be exposed on the outside to mar the overall design and appearance of the upper garment. Besides, the garment may be partially opened when the patient is receiving examination or treatment. As shown in FIG. 2, the right sleeve 5 may also have a detachable end portion to provide convenience in medical examination.

Although the present invention has been illustrated and described with reference to the preferred embodiment thereof, it should be understood that it is in no way limited to the details of such embodiment but is capable of numerous modifications within the scope of the appended claims.

What is claimed is:

1. A partially or fully openable upper garment for patients comprising a left front piece, a right front piece, a back piece, a left sleeve and a right sleeve sewn together, said left front piece and said right front piece being joined by a first fastening device, wherein at least said left front piece or said right front piece is provided with a slit in one side thereof running lengthwise of said left front piece or said right front piece and its contiguous sleeve, and a second fastening device is provided at said slit comprising a zipper having two slides oppositely disposed at either end of said second fastening device each of which forming a tail portion at the respective end of said second fastening device wherein a front end of the zipper is disposed between the waist and the chest of the patient and the portion of the slit therebelow is detached.

* * * * *